US011293118B2

(12) United States Patent
Ellenbogen

(10) Patent No.: US 11,293,118 B2
(45) Date of Patent: Apr. 5, 2022

(54) FABRIC THAT HAS UTILITY TO EXPAND ITS' SURFACE AREA

(71) Applicant: Dane Robert Ellenbogen, Austin, TX (US)

(72) Inventor: Dane Robert Ellenbogen, Austin, TX (US)

( * ) Notice: Subject to any disclaimer, the term of this patent is extended or adjusted under 35 U.S.C. 154(b) by 184 days.

(21) Appl. No.: 16/710,253

(22) Filed: Dec. 11, 2019

(65) Prior Publication Data

US 2021/0180218 A1 Jun. 17, 2021

(51) Int. Cl.

| | |
|---|---|
| ***D02G 3/38*** | (2006.01) |
| ***D02G 3/32*** | (2006.01) |
| ***D02G 3/36*** | (2006.01) |

(52) U.S. Cl.

CPC ..... *D02G 3/38* (2013.01); *D02G 3/32* (2013.01); *D02G 3/36* (2013.01); *D10B 2201/02* (2013.01)

(58) Field of Classification Search

CPC ... D02G 3/32; D02G 3/36; D02G 3/38; D04C 1/06; D10B 2201/02

See application file for complete search history.

(56) References Cited

U.S. PATENT DOCUMENTS

| | | | | |
|---|---|---|---|---|
| 3,127,731 | A | 4/1964 | Mckinnon | |
| 3,828,544 | A * | 8/1974 | Alker | D02G 3/36 57/210 |
| 6,148,865 | A * | 11/2000 | Head | B29C 70/222 138/123 |
| 2006/0185343 | A1* | 8/2006 | Coombs | D02G 3/38 57/210 |
| 2016/0160406 | A1* | 6/2016 | Agarwal | D02G 1/08 139/421 |
| 2018/0160756 | A1* | 6/2018 | Benefiel | A41H 3/007 |
| 2018/0245249 | A1* | 8/2018 | Yenici | D02G 1/028 |
| 2019/0166932 | A1* | 6/2019 | Taylor | A41D 19/0096 |
| 2019/0273199 | A1* | 9/2019 | Tajitsu | H01L 41/1132 |

* cited by examiner

*Primary Examiner* — Ryan A Reis

(57) ABSTRACT

A knitted component with the function to expand its surface area in all directions due to the utility of the thread. The thread is comprised of an axial braided sleeve around a tensile plastic core thread.

1 Claim, 2 Drawing Sheets

Figure 1
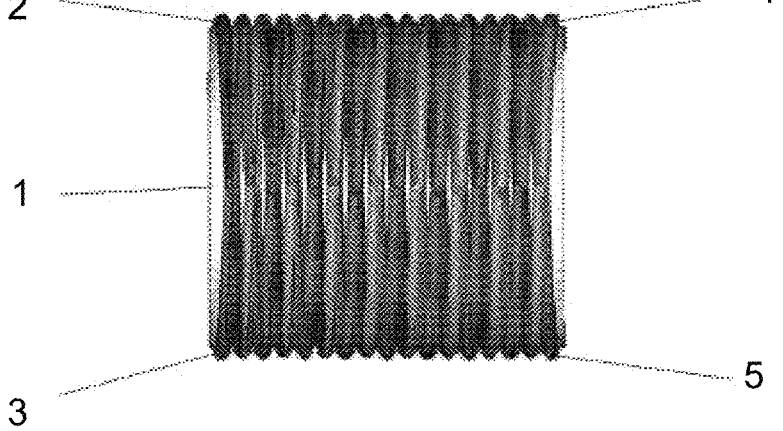
Figure 2
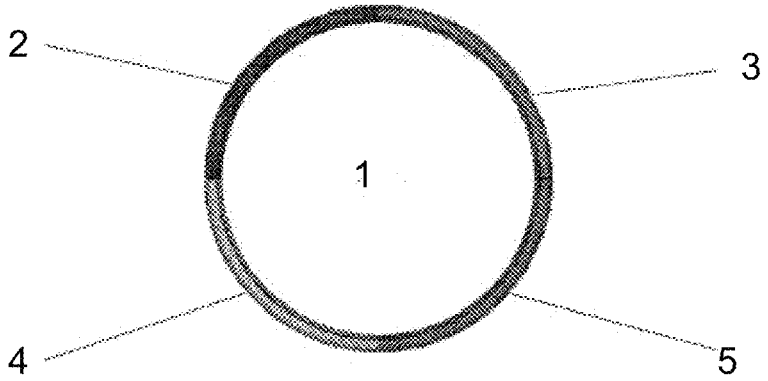
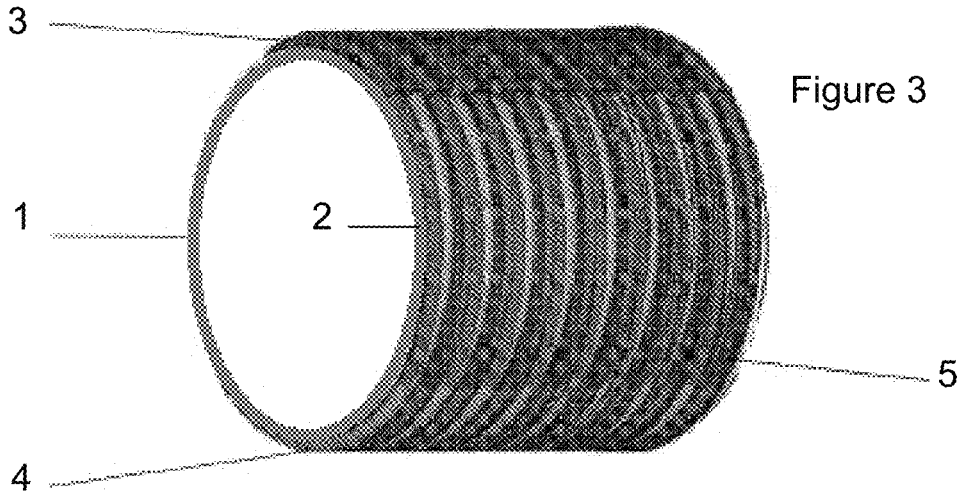
Figure 3

FABRIC THAT HAS UTILITY TO EXPAND ITS' SURFACE AREA

BACKGROUND

Field of the Invention

The present invention relates to manufacturing knitted components with utility from specially woven thread and more particularly to manufacturing a braided sleeve around a malleable and tensile core thread.

Description of the Related Art

Prior related art to the example invention is U.S. Pat. No. 3,127,731A, which is plastic core yarn, which relates to some of the materials used for the utility of the example invention but they differ in structure and utility; and U.S. Pat. No. 6,148,865A, which is axial woven structures, which relates to the structure of the outside sleeve of the example invention but they differ in materials used and utility.

SUMMARY

A knitted component with the utility to increase its surface area. Each individual thread is a braided sleeve around a malleable and tensile core.

BRIEF DESCRIPTION OF THE DRAWINGS

Briefly describe each drawing and flowchart

FIG. 1—A side view of a single thread with utility to expand and hold its shape.

FIG. 2—A top view of a single thread with utility to expand and hold its shape.

FIG. 3—An isometric view of a single thread with utility to expand and hold its shape.

DETAILED DESCRIPTION

Figure 4:
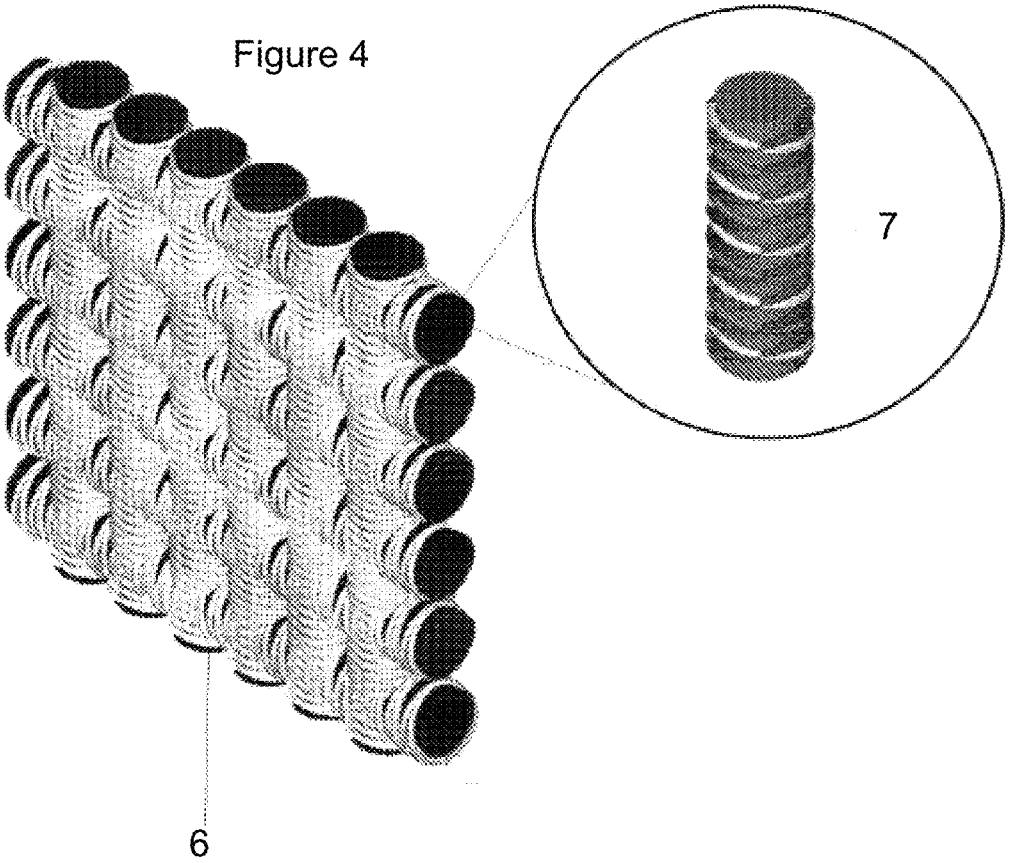
FIG. 4—An isometric view of a sample of woven fabric composed of threads with utility to expand and hold its shape.

This invention is utilized for fabric that can expand to the users preferences. The fabric is comprised of specially manufactured thread that can extend in length, whilst decreasing in circumference. 8 weight cotton fiber strands are woven in an axial braid, with 4 of the strands being woven clockwise at a 45 degree angle and the other 4 strands at equal distances apart being woven counter clockwise at a 45 degree angle to create a cloth axial braided sleeve. Because of the cotton make up the sleeve has no rigid structure without it's internal skeleton, ex. loose cloth Chinese finger trap. Thus the internal skeleton is a tensile plastic core that can be stretched up to a minimum 1.5 times its original length before breaking. The braided sleeve is fused to the plastic core thread every three inches in order to evenly pull the cotton fibers tight whilst the internal core thread is being drawn out. The internal circumference of the axial braided sleeve decreases with its plastic core thread by the ends getting pulled tightly, while the length of the sleeve extends with the core thread. Since the original 'loose' sleeve is pulled 'tight' by it's length, it grips the internal core thread as a vice in order to contain any part of the plastic core thread that may break from excessive drawing out. The final composed and 'undrawn' threads are woven into an Oxford weave, which is a variation of a plain weave. The resulting fabric is able to be manipulated to lengthen and widen in surface area, with widening gaps between the threads makes the original opaque fabric into more transparent, ex. shirt that becomes a sweater (only referencing the gaps between threads and not thickness or utility of the fabric).

Drawings References

1—The core thread that is malleable in nature. Using cold drawing from two points to extend the thread further in length as width is stretched thin.

2—An axial braided fiber, revolving clockwise around the core thread. The braid is threaded through corresponding 3 represented fibers in order over 1 fiber, under 2 fibers, over 1, under 2, etc.

3—An axial braided fiber, revolving counter-clockwise around the core thread. The braid is threaded through corresponding 3 represented fibers in order under 1 fiber, over 2 fibers, under 1, over 2, etc.

4—An axial braided fiber, revolving counter-clockwise around the core thread. The braid is threaded through corresponding 3 represented fibers in order under 1 fiber, over 2 fibers, under 1, over 2, etc.

5—An axial braided fiber, revolving clockwise around the core thread. The braid is threaded through corresponding 3 represented fibers in order over 1 fiber, under 2 fibers, over 1, under 2, etc.

6—A knitted component consisting of 12 axial braided fibers with a cored thread (string), represented as 6 vertical strings and 6 horizontal strings in an "Oxford" or "Pinpoint Oxford" weave.

7—A completed string consisting of axial woven fibers around a malleable core thread. This "zoom view" of the string is a representation of looking at any of the identical 12 strings in FIG. 4.

8—A knitted component consisting of 12 axial braided fibers with a cored thread (string), represented as 6 vertical strings and 6 horizontal strings in an "Oxford" or "Pinpoint Oxford" weave. The arrows pointing directly away from all sides of the knitted components are a representation of pulling each side from the ends in the direction of the arrows with equal force at the same time.

Figure 5:
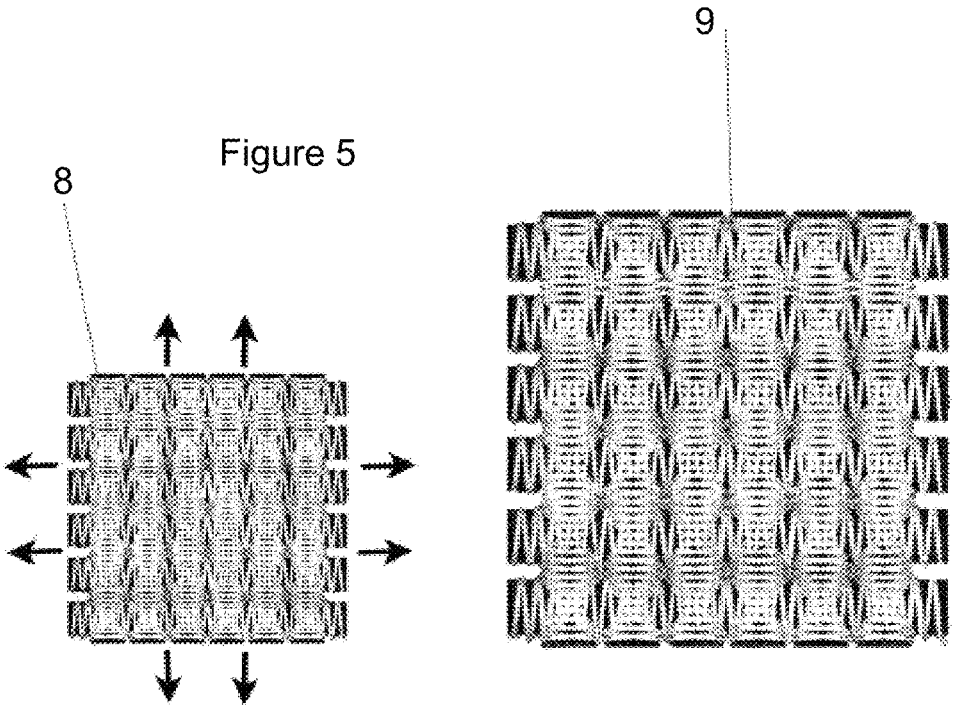
FIG. 5—A front view of a sample of woven fabric composed of threads with utility to expand and hold its shape expanding into its larger form.

9—FIG. 5 is represented after pulling the ends equally as the same proportions but extended length and width to create a larger surface area of the original knitted component. The core thread while extending in length loses thickness, and the vacant space is occupied by the axial woven fibers that are tightened as they are extended along with the core thread.

The invention claimed is:

1. A fabric comprising:

a tensile plastic core; and a braided sleeve surrounding the tensile plastic core, the braided sleeve being made of four cotton fiber strands woven clockwise at a 45 degree angle and another four cotton fiber strands woven counter-clockwise at a 45 degree angle;

wherein the braided sleeve is fused to the tensile plastic core every three inches along the tensile plastic core.

* * * * *